US012365520B2

(12) United States Patent
Noveletsky

(10) Patent No.: US 12,365,520 B2
(45) Date of Patent: Jul. 22, 2025

(54) DISPENSING LID

(71) Applicant: Zak Designs, Inc., Spokane, WA (US)

(72) Inventor: Tyler Noveletsky, East Falmouth, MA (US)

(73) Assignee: Zak Designs, Inc., Spokane, WA (US)

( * ) Notice: Subject to any disclaimer, the term of this patent is extended or adjusted under 35 U.S.C. 154(b) by 0 days.

(21) Appl. No.: 18/324,429

(22) Filed: May 26, 2023

(65) Prior Publication Data

US 2024/0391656 A1 Nov. 28, 2024

(51) Int. Cl.

| | |
|---|---|
| ***B65D 47/08*** | (2006.01) |
| ***A47G 19/22*** | (2006.01) |
| ***B65D 43/02*** | (2006.01) |
| ***B65D 47/06*** | (2006.01) |

(52) U.S. Cl.

CPC ..... *B65D 47/0895* (2013.01); *A47G 19/2272* (2013.01); *B65D 47/065* (2013.01); *B65D 43/0229* (2013.01); *B65D 2539/006* (2013.01); *B65D 2547/063* (2013.01)

(58) Field of Classification Search

CPC ..... B65D 47/0895; B65D 47/065; B65D 43/0229; B65D 2539/006; B65D 2547/063; A47G 19/2272

USPC ..... 220/254.2, 254.3; 222/566

See application file for complete search history.

(56) References Cited

U.S. PATENT DOCUMENTS

| | | | | |
|---|---|---|---|---|
| 3,718,238 | A * | 2/1973 | Hazard | B65D 47/305 222/536 |
| 8,668,106 | B1 * | 3/2014 | Joy | A47G 19/2272 220/717 |
| 8,672,174 | B1 * | 3/2014 | McMullin | B65D 47/305 222/533 |
| 10,159,368 | B2 | 12/2018 | Lin | |
| D867,057 | S | 11/2019 | Spivey | |
| D889,199 | S | 7/2020 | Shepard | |
| D899,849 | S | 10/2020 | Zhang | |
| D905,499 | S | 12/2020 | Zhang | |

(Continued)

FOREIGN PATENT DOCUMENTS

| | | |
|---|---|---|
| CN | 307366953 | 5/2022 |
| CN | 308897589 | 10/2024 |
| CN | 309000718 | 12/2024 |

OTHER PUBLICATIONS

Unpublished Des. U.S. Appl. No. 29/876,721, filed May 26, 2023 and entitled "Dispensing Container Lid".

(Continued)

*Primary Examiner* — James N Smalley
(74) *Attorney, Agent, or Firm* — Randall Danskin, PS

(57) ABSTRACT

A dispensing lid includes a body with a first well therein and a port and a conduit in the first well. The dispensing lid includes a cap in rotatable engagement with the body and having a second well therein. The cap is rotatable from a closed position of the cap, in which the cap nests in the first well and engages with and closes the port, to an open position of the cap, in which the cap disengages from and opens the port. The dispensing lid includes a spout in rotatable engagement with the cap and having a conduit extending therethrough. The spout is rotatable from a closed position of the spout, in which the spout nests in the cap, to an open position of the spout, in which the conduit of the spout aligns with the conduit of the body when the cap is in its closed position.

20 Claims, 9 Drawing Sheets

(56) References Cited

U.S. PATENT DOCUMENTS

| | | | | |
|---|---|---|---|---|
| D935,883 | S | 11/2021 | Wilcox | |
| 11,589,695 | B2 * | 2/2023 | Spivey | B65D 43/16 |
| D990,983 | S | 7/2023 | Wang | |
| D1,006,538 | S | 12/2023 | Xu | |
| D1,012,605 | S | 1/2024 | Chen | |
| D1,019,271 | S | 3/2024 | Chen | |
| D1,028,624 | S | 5/2024 | Wang | |
| D1,041,245 | S | 9/2024 | Yao | |
| D1,044,391 | S | 10/2024 | Yao | |
| D1,047,580 | S | 10/2024 | Yao | |
| D1,049,768 | S | 11/2024 | Yao | |
| D1,050,806 | S | 11/2024 | Yao | |
| D1,051,662 | S | 11/2024 | Chen | |
| D1,051,663 | S | 11/2024 | Chen | |
| D1,055,630 | S | 12/2024 | Fang | |
| 2016/0114937 | A1 | 4/2016 | Hylton | |
| 2018/0332987 | A1 | 11/2018 | Lin | |
| 2019/0092540 | A1 | 3/2019 | Spivey | |
| 2022/0041348 | A1 | 2/2022 | Liss | |

OTHER PUBLICATIONS

Built Cascade and Straw Lid [online]; published date unknown, [retrieved on Feb. 14, 2025]. URL: https:www.builtny.com/products/20-oz-wide-mouth-cascade-with-straw-lid (9 pages) (Year: 2025).
Harmony Sip and Straw [online]; published date unknown, [retrieved on Feb. 18, 2025]. URL: https://www.zak.com/products/harmony-2-in-1-tumbler-30-oz-cream (13 pages) (Year: 2025).
Stanley IceFlow Flip Straw [online]; published to internet Apr. 11, 2024, [retrieved on Feb. 14, 2024]. URL: https://a.co/d/j1Wlvgu (11 pages) (year: 2024).

* cited by examiner

DISPENSING LID

BACKGROUND

Various personal, dispensing containers and related covers or lids have been fabricated and sold over many decades. In the present day, such devices designed to contain liquids are often referred to generically as "water bottles," though they frequently contain liquids other than water, or simply "bottles." For many years, these personal, liquid-dispensing containers and their associated covers or lids, or water bottles, have been designed to meet the particular needs of users during their various events and activities.

For example, many users of these prior art drinking vessels often desire to consume the contents of the drinking vessel quickly. The prior art liquid dispensing containers have not, generally speaking, been designed to rapidly deliver large volumes of liquid from the dispensing container. A wide-open lid capable of delivery large volumes of liquid could spill the liquid more easily in the event that the drinking vessel is accidentally overturned. Consequently, smaller volumes of liquid are often dispensed from most fluid dispensing containers, such as through a straw arrangement. Accordingly, drinking vessels with greater versatility would be beneficial.

One container described in U.S. Pat. No. 10,159,368 includes a lid with both a straw and a sipper opening. Users may select which dispensing option to use. However, operation involves a complex mix of at least seven separate components of the lid alone.

Accordingly, designs that increase the simplicity of function and assembly would be beneficial.

BRIEF DESCRIPTION OF THE DRAWINGS

Some embodiments are described below with reference to the following accompanying drawings.

DETAILED DESCRIPTION

Figure 1:
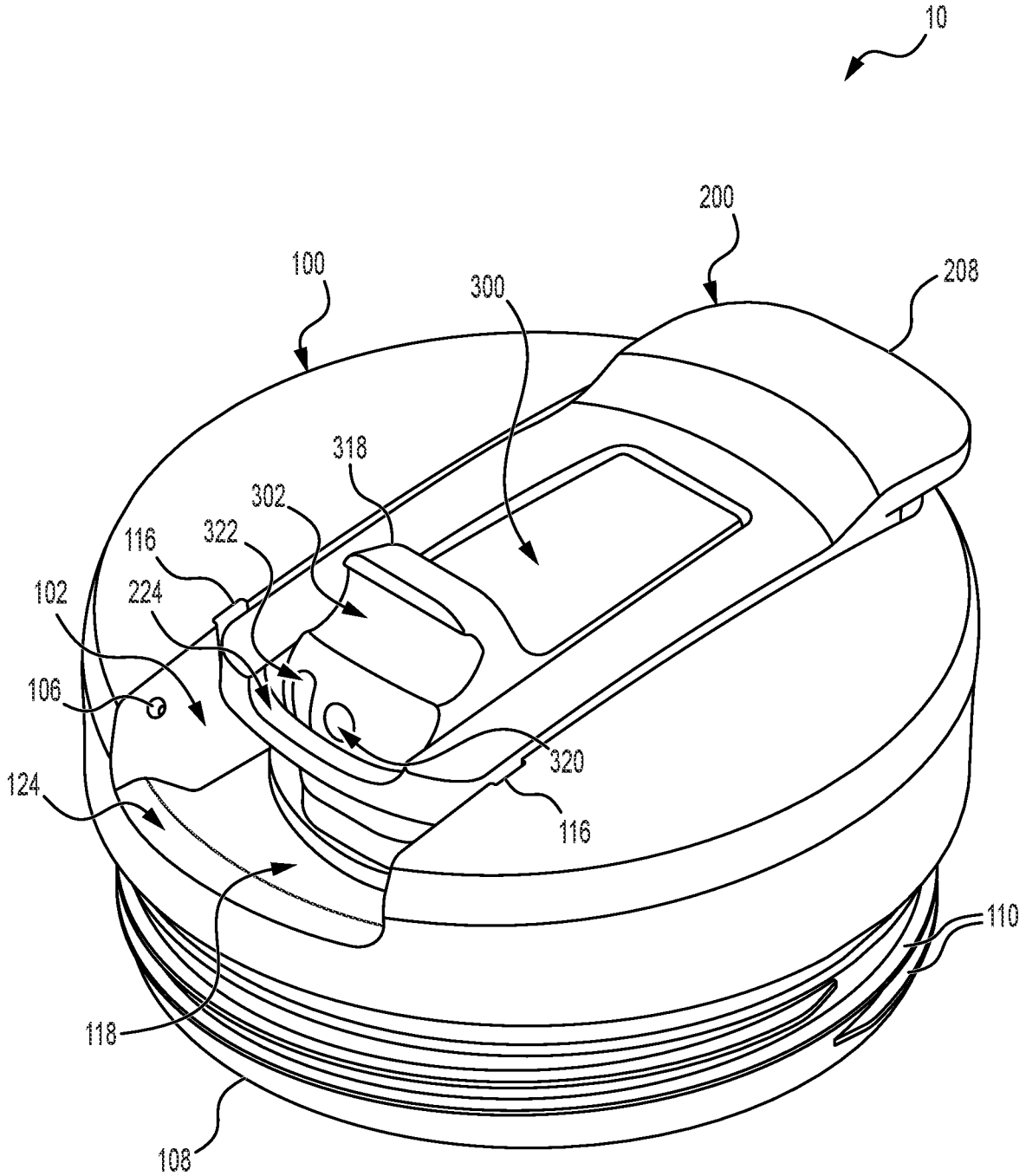
FIG. 1 is an isometric view of an example dispensing lid described herein with a cap and a spout in closed positions.

The example implementations described herein refer to the accompanying drawings. The same reference numerals in the various drawings may identify the same or similar features.

In some instances, providing multiple dispensing options involves providing numerous components, such as seals, closures, and devices for manipulating them. Some examples described herein simplify the function and assembly of a dispensing lid with multiple dispensing options by using one or more components with multiple purposes applicable to multiple dispensing options. Therefore, some implementations described herein simplify manufacturing and assembly by reducing the number of components. By virtue of the reduced number of components, some implementations described herein also simplify the function of a dispensing lid.

As indicated above, FIGS. 1-9 are provided merely as examples. Other examples are possible and may differ from what is described with regard to FIGS. 1-9.

Figure 2:
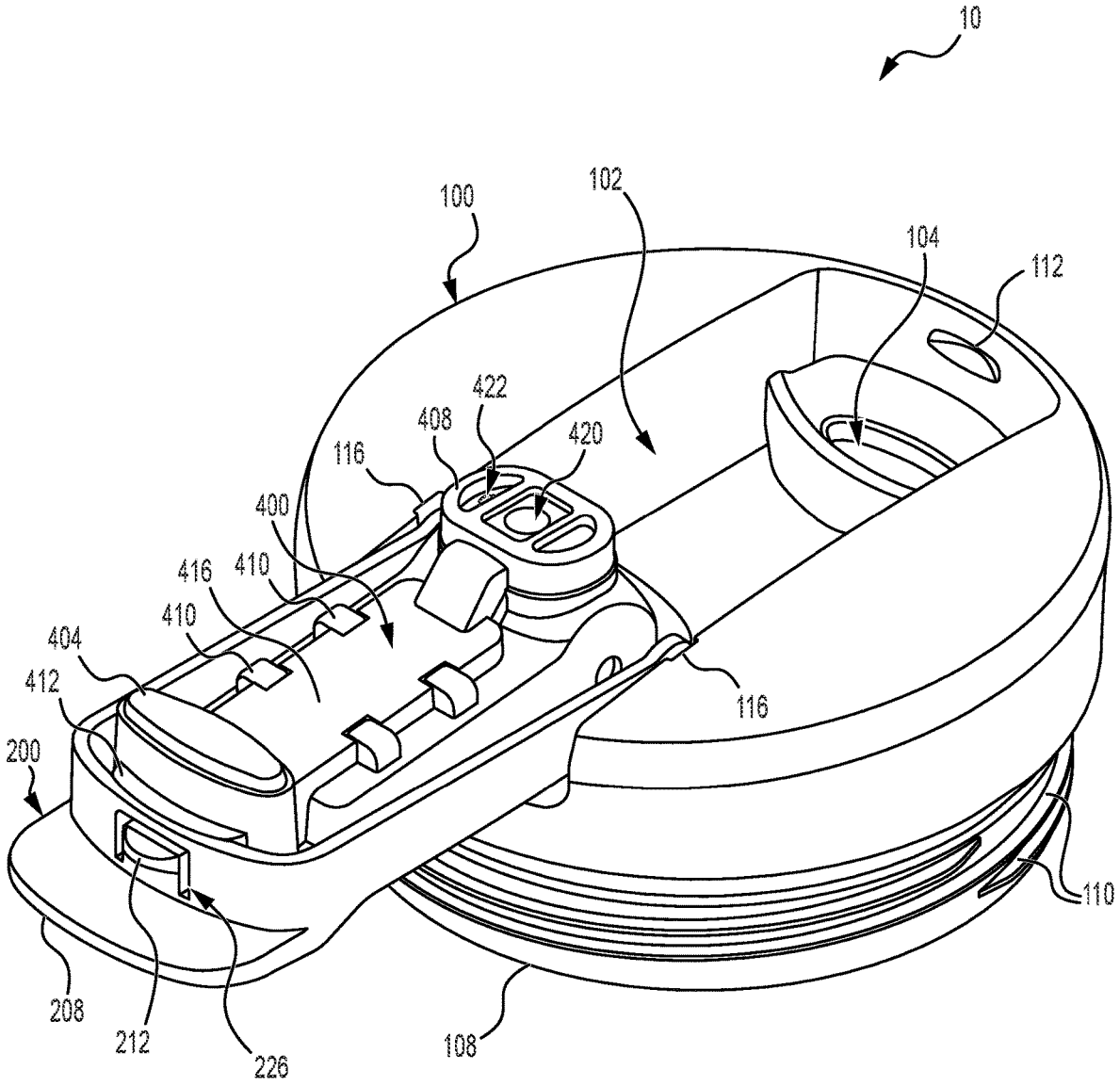
FIG. 2 is an isometric view of the dispensing lid in FIG. 1 with the cap in an open, retained position and the spout in a closed position.
Figure 3:
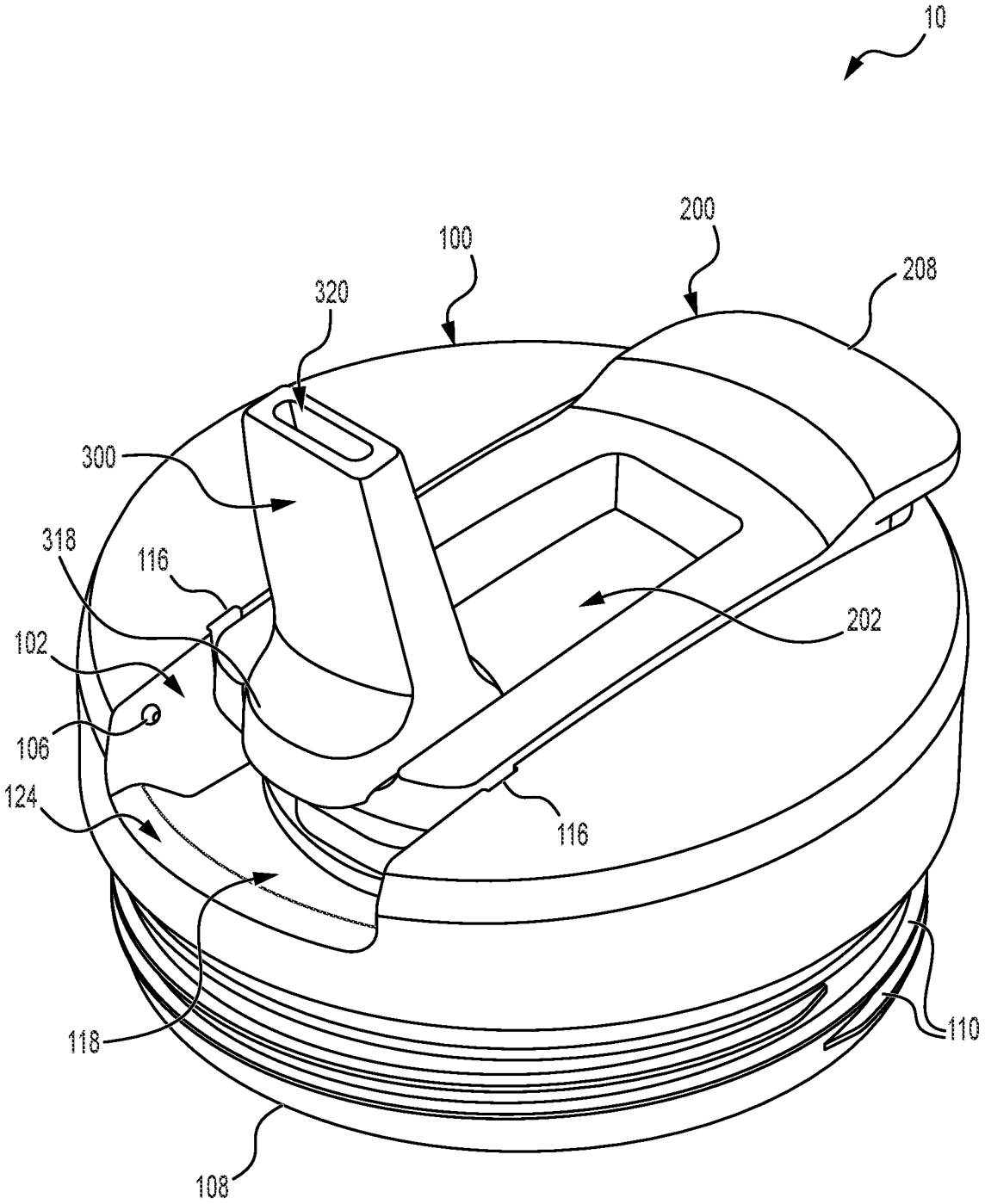
FIG. 3 is an isometric view of the dispensing lid in FIG. 1 with the cap in a closed position and the spout in an open position.

FIGS. 1-3 show isometric views of a dispensing lid 10, according to an example implementation, for use with a container (not shown). Dispensing lid 10 includes a body 100 with a circumscribing side wall 108 extending downward and including a thread 110. Accordingly, in the example implementation shown, dispensing lid 10 is engaged in sealing association with a container (not shown) having a threaded structure corresponding to thread 110. Although a threaded engagement is shown in FIGS. 1-3, it will be appreciated that a variety of known structures for engaging lid 10 in sealing association may be used.

In addition to body 100, lid 10 includes a cap 200 in rotatable engagement with body 100 and a spout 300 in rotatable engagement with cap 200. FIGS. 1-3 show cap 200 and spout 300 in various positions. In FIG. 1, both cap 200 and spout 300 are in closed positions. In FIG. 2, spout 300 is in a closed position, though it cannot be seen in the view shown, while cap 200 is in an open, retained position. In FIG. 3, cap 200 is in a closed position and spout 300 is in an open position.

Figure 4:
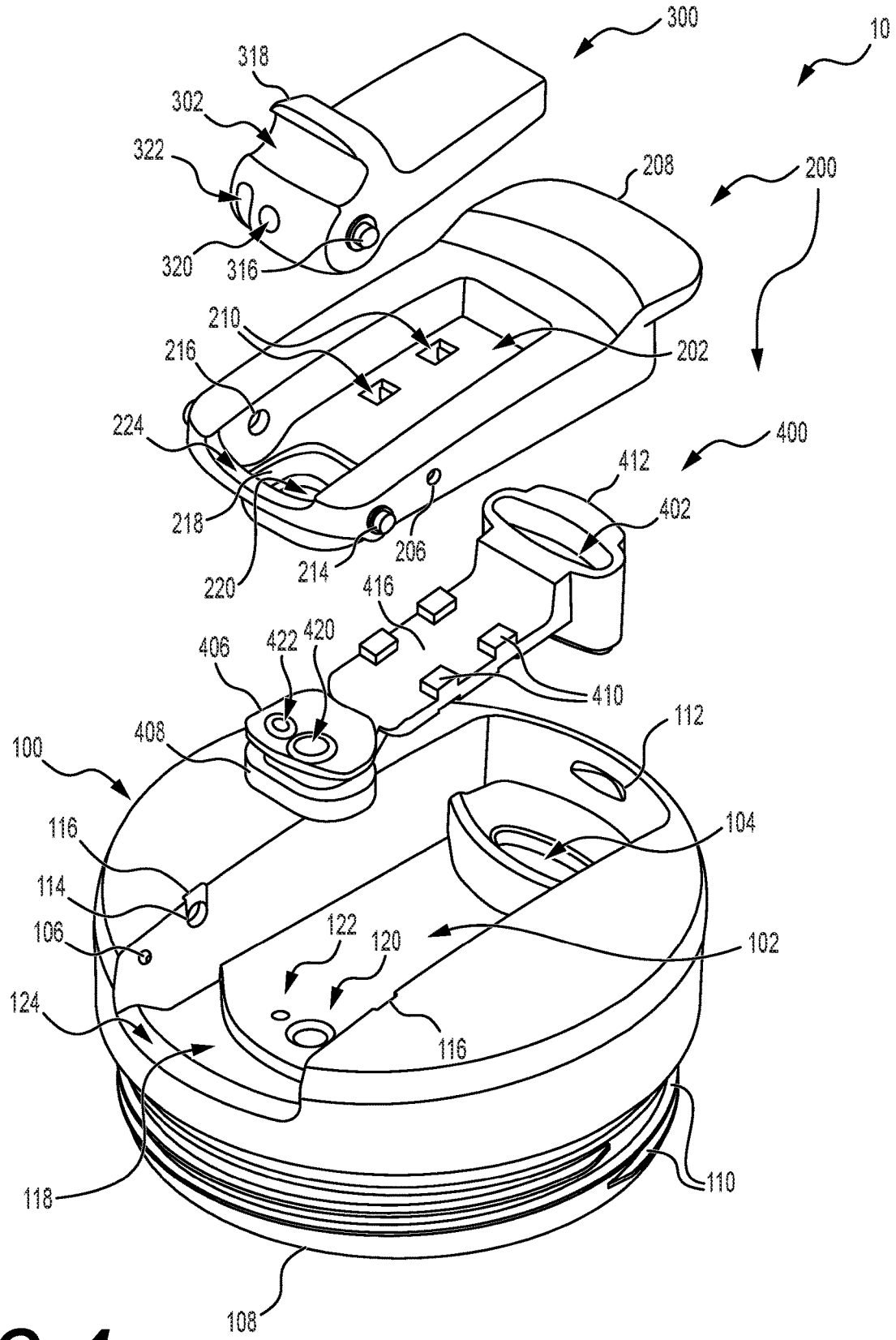
FIG. 4 is an exploded isometric view of the dispensing lid in FIG. 1.
Figure 5:
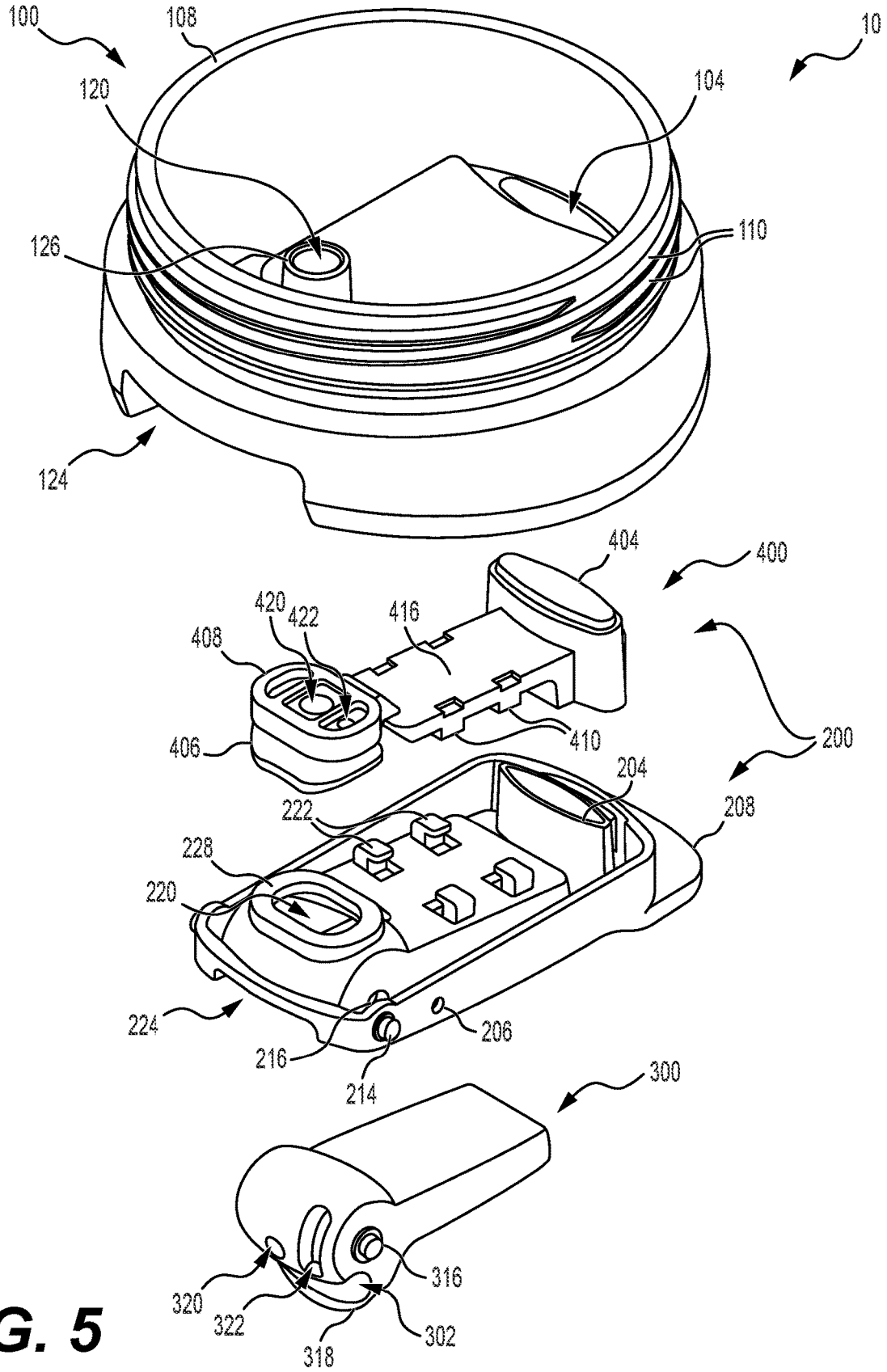
FIG. 5 is an inverted view of the exploded, isometric view shown in FIG. 4.
Figure 6:
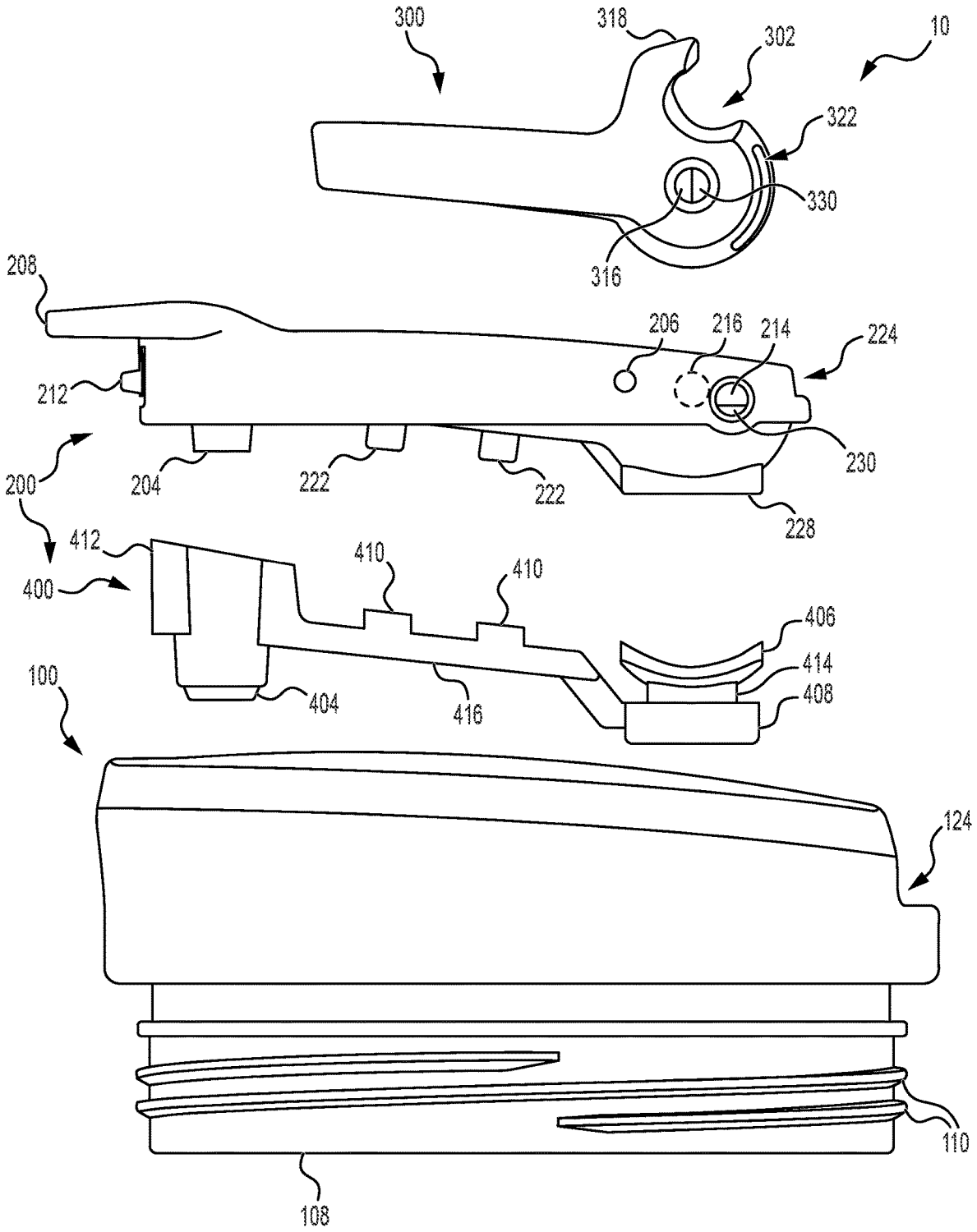
FIG. 6 is a side view of the exploded, isometric view shown in FIG. 4.
Figure 7:
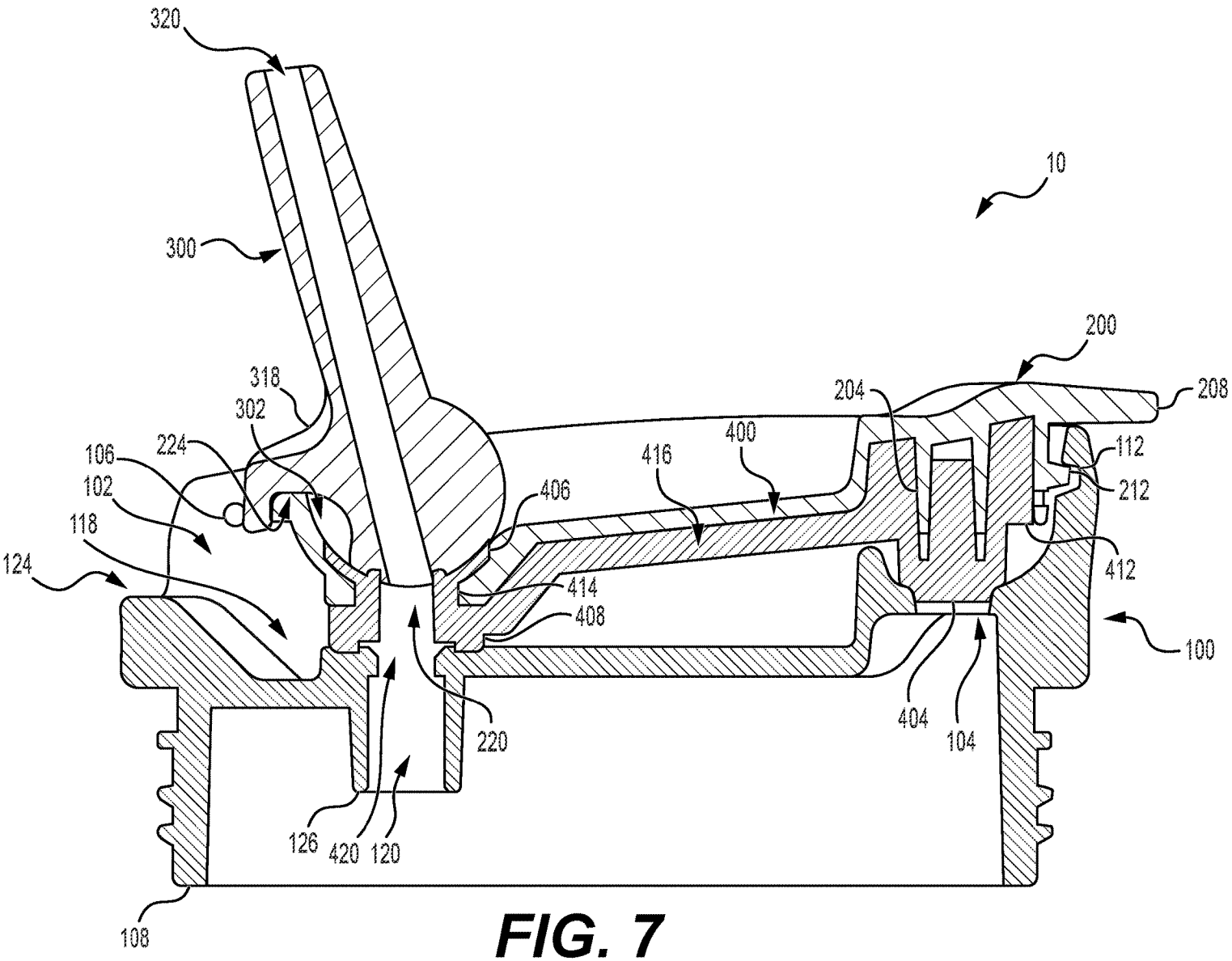
FIG. 7 is a sectional view of the dispensing lid shown in FIG. 3.
Figure 8:
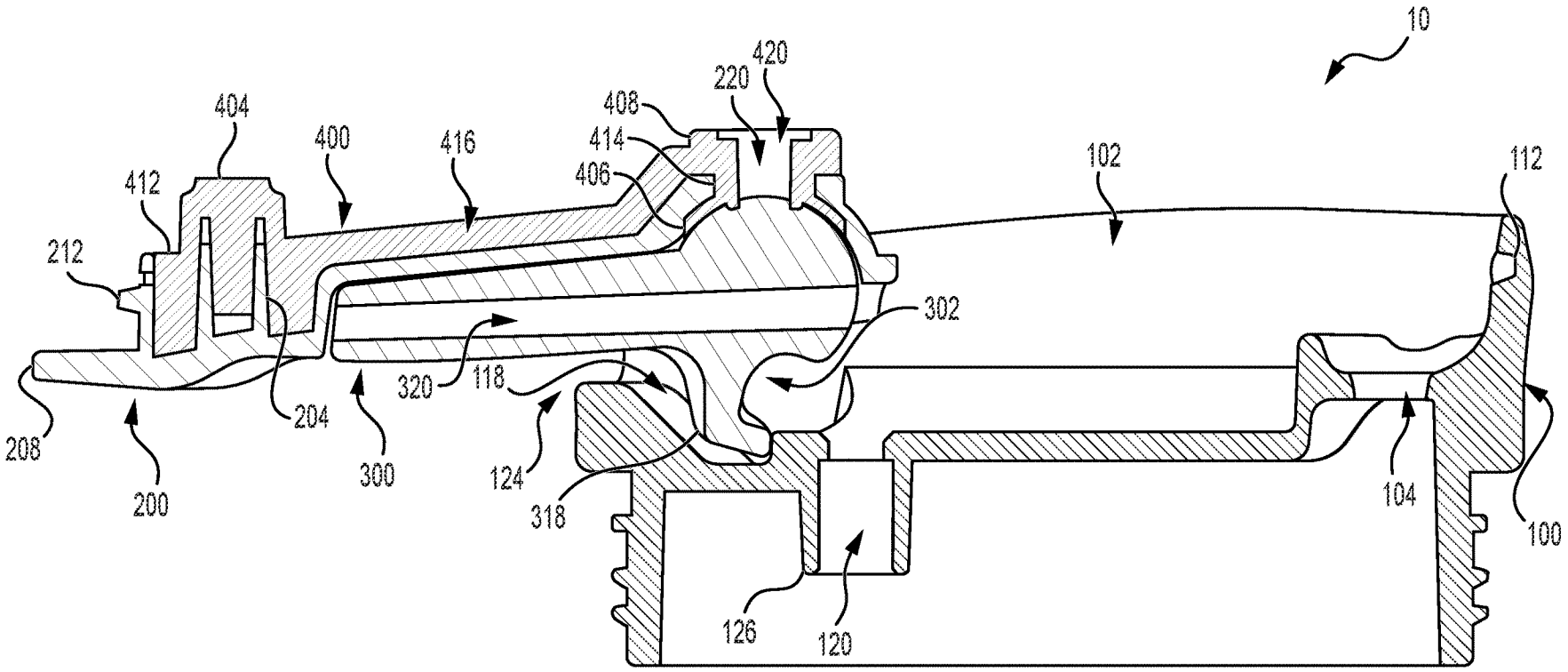
FIG. 8 is a sectional view of the dispensing lid shown in FIG. 2.

FIGS. 4-6 show lid 10 of FIG. 1 in exploded views, revealing the structures that allow the multiple combinations of positions shown in FIGS. 1-3 for cap 200 and spout 300. FIGS. 7 and 8 show lid 10 of FIGS. 3 and 2, respectively, in sectional views, revealing further structures. Accordingly, FIGS. 1-8 show that body 100 includes a first well 102 formed therein and a port 104 and a conduit 120 in first well 102 and extending through body 100. Cap 200 includes a second well 202 formed therein. Cap 200 is rotatable about a first axis of rotation from the closed position of cap 200 shown in FIGS. 1 and 3 to an open position of cap 200.

In the closed position of cap 200, it nests in first well 102 and engages with and closes port 104. In the open position of cap 200, it disengages from and opens port 104, allowing dispensing through lid 10 via port 104. Thus, it will be appreciated that the open, retained position shown in FIG. 2 is one of several possible open positions as cap 200 rotates from the point where it disengages from and opens port 104 to the open, retained position of FIG. 2.

Spout 300 includes a conduit 320 extending therethrough. Spout 300 is rotatable about a second axis of rotation from a closed position of spout 300 shown in FIG. 1 to an open position of spout 300 shown in FIG. 3. In the closed position of spout 300, it nests in cap 200. In the open position of spout 300, conduit 320 of spout 300 aligns with conduit 120 of body 100 when cap 200 is in its closed position, allowing dispensing through lid 10 via spout 300.

In the example implementation shown in FIGS. 1-8, cap 200 includes a passage 220 in second well 202 extending through cap 200. Passage 220 aligns with conduit 120 of body 100 when cap 200 is in its closed position. Also, conduit 320 of spout 300 aligns with passage 220 of cap 200 in the open position of spout 300. In such manner, with cap 200 closed and spout 300 open, passage 220 allows dispensing through cap 200 via passage 220 and, thus, through lid 10 via spout 300. Therefore, cap 200 and spout 300 function cooperatively to allow dispensing through lid 10 with cap 200 in its closed position and spout 300 in its open position. The cooperative function of cap 200 and spout 300 provides a simplified function and assembly of lid 10.

In the example implementation of FIGS. 1-8, cap 200 includes a resilient seal 400 attached thereto. Seal 400 is shown as a part of cap 200 in FIGS. 1-3, 7, and 8. Though seal 400 is split apart from cap 200 in FIGS. 4-6, seal 400 is nonetheless part of cap 200. Dispensing lid 10 conceivably could function very similarly to what is shown in FIGS. 1-8 without a resilient seal if sealing surfaces were fabricated with very close tolerances and held securely in place. However, seal 400 provides several benefits.

Seal 400 includes a port gasket 404 that engages with and closes port 104 in the closed position of cap 200. Seal 400 also includes a spout gasket 406 that engages between and with both spout 300 and other parts of cap 200 while spout 300 rotates from its closed position to its open position. Seal 400 further includes a body gasket 408 that engages between and with both body 100 and other parts of cap 200 in the closed position of cap 200. Port gasket 404, spout gasket 406, and body gasket 408 are formed from a continuous material in common.

It follows that seal 400 may include a bridge 416 of the continuous material in common extending between port gasket 404 and body gasket 408. Also, seal 400 may include a tube 414 of the continuous material in common extending between body gasket 408 and spout gasket 406. In this manner, port gasket 404, spout gasket 406, and body gasket 408 are all connected by and formed from a continuous material in common.

While other structural configurations are conceivable, the example implementation of seal 400 in FIGS. 1-8 may be conveniently formed in a single mold. In such manner, no interfaces or adhesives would exist between the components of seal 400 shown. Also, the configuration of seal 400 facilitates secure retention in cap 200, as described below. Suitable substances for the continuous material include a variety of resilient materials known for use in gaskets that may be formed in a shape sufficient to provide the described structures and benefits. For example, silicone may be used.

To provide the dispensing features of body 100 and spout 300 described above, seal 400 may include a conduit 420 through tube 414 that aligns with conduit 120 of body 100 and conduit 320 of spout 300 when spout 300 is in its open position and cap 200 is in its closed position. In such manner, lid 10 allows dispensing via spout 300.

In the example implementation of FIGS. 1-8, venting capabilities are included. Body 100 may include a duct 122 in first well 102 and extending through body 100. Spout 300 may include a duct 322 formed therein. Seal 400 may include a duct 422 through tube 214 that aligns with duct 122 of body 100 and duct 322 of spout 300 when spout 300 is in its open position and cap 200 is in its closed position. Accordingly, lid 10 allows venting via spout 300 during dispensing. Closing spout 300 moves duct 322 out of alignment with duct 422, closing the vent.

A seal different from seal 400 may be used other implementations not shown in FIGS. 1-8. In the absence of seal 400, body 100 may include duct 122 in first well 102 and extending through body 100. Spout 300 may include duct 322 formed therein. Duct 322 of spout 300 may align with duct 122 of body 100 when spout 300 is in its open position and cap 200 is in its closed position, allowing venting through lid 10 via spout 300 during dispensing. Some other arrangement (not shown) may be provided for sealing interfaces between the components.

In the example implementation of FIGS. 1-8, the first axis of rotation is parallel to, and not coincident with, the second axis of rotation. The first axis of rotation of cap 200 may be appreciated from the rotatable engagement of cap 200 with body 100. The rotatable engagement may include a pair of pegs 214 on opposing sides of cap 200 engaged inside a pair of sockets 114 on opposing sides of first well 102 in body 100.

In the example implementation of FIGS. 1-8, pegs 214 are located on cap 200 while sockets 114 are located in body 100. It is conceivable that the peg/socket location may be switched. That is, a peg similar to peg 214 may be located in well 102 of body 100 while a socket similar to socket 114 may be located on cap 200. In either arrangement, the first axis of rotation may extend through cap 200 between the centers of pegs 214 and sockets 114.

The location for pegs 214 and sockets 114 shown in FIGS. 1-8 provides the benefit of simplicity in manufacture and assembly. Recesses 116 adjacent and leading into sockets 114 provide a guide for pegs 214 during assembly. Also, pegs 214 each include a bevel 230 (see FIG. 6) on top of pegs 214 that registers with recesses 116 during assembly. Bevels 230 of pegs 214 positioned on a lower edge of pegs 214 allow sliding into sockets 114, but not sliding out of sockets 114.

The second axis of rotation may be appreciated from the rotatable engagement of spout 300 with cap 200. The rotatable engagement may include a pair of pegs 316 on opposing sides of spout 300 engaged inside a pair of sockets 216 on opposing sides of second well 202 in cap 200. Pegs 316 include bevels 330 (see FIG. 6) analogous to bevels 230. With spout 300 oriented upward, bevels 330 would appear on the lower edges of pegs 316 for assembly in a manner analogous to that described above for pegs 214 and with similar benefits.

In the example implementation of FIGS. 1-8, pegs 316 are located on spout 300 while sockets 216 are located in cap 200. It is conceivable that the peg/socket location may be switched. That is, a peg similar to peg 316 may be located in well 202 of cap 200 while a socket similar to socket 216 may be located on spout 300. In either arrangement, the second axis of rotation may extend through spout 300 between the centers of pegs 316 and sockets 216. For the reasons described above, the location for pegs 316 and sockets 216 shown in FIGS. 1-8 provides the benefit of simplicity in manufacture and assembly.

FIG. 5 shows socket 216 in cap 200 with hidden lines offset from peg 214. It follows that peg 214 defines the first axis of rotation as offset from the second axis rotation defined by socket 216. Peg 214 (and, thus, the first axis of rotation) is also offset from a lateral center of body gasket 408. The offset permits body gasket 408 to swing out of engagement with body 100 when cap 200 is rotated out of its closed position.

Body 100 may include a pair of bosses 106 on opposing sides of first well 102. Cap 200 may include a pairs of stops 206 on opposing sides of cap 200. In the example implementation of FIGS. 1-8, stops 206 are recesses, but other known structures are conceivable. The pair of stops 206 in cap 200 may register to the pair of bosses 106 in first well 102 when spout 300 is in its closed position and cap 200 is in an open, retained position, such as shown in FIG. 2.

Although the pair of bosses 106 are on body 100 and the pair of stops 206 are on cap 200, their locations may be swapped. The pair of stops 206 could conceivably be located on body 100 and the pair of bosses 106 could conceivably be located on cap 200. Also, the pair of bosses/stops could conceivable be only one boss and one stop, but the retention would be less secure and potentially shift cap 200 toward the opposite side of first well 102 from where the boss/stop is located.

When a user opens port 104 by moving cap 200 to an open position, the user generally inverts the dispensing container to pour liquid out of port 104. Consequently, if cap 200 is not somehow restrained, it could swing back toward the closed position of cap 200, potentially striking the user or unintentionally closing port 104. Provision of the boss/stop combination permits restraining cap 200 in an open, retained position when the pair of bosses 106 registers with the pair of stops 206.

Rotating cap 200 to the open, retained position of FIG. 2 is facilitated by the structural features of the example implementation shown in FIGS. 1-8. That is, cap 200 includes a ledge 208 allowing a user to easily grasp cap 200 and move it into and out of the closed position shown in FIG. 1.

Also, spout 300 includes a lever 318 extending outward from spout 300 when spout 300 is in its closed position. As an accommodation, first well 102 includes a hollow 118 shaped to receive lever 318 when cap 200 is in its open, retained position. Body 100 further includes a trough 124 that receives cap 200 when rotated into the open, retained position of FIG. 2.

If well 102 did not include a portion designated to accommodate lever 318 of spout 300, then lever 318 could obstruct full rotation of cap 200 into the open, retained position. The same is true for trough 124. While a variety of structural configurations are conceivable among well 102, hollow 118, lever 318, and trough 124, the structural configuration of the example implementation in FIGS. 1-8 accommodates fully opening cap 200 to 180° from the closed position in FIG. 1, reaching the open, retained position in FIG. 2. The described extent of rotation accommodates greater access to port 104 when dispensing therefrom, such as, when a user drinks from port 104. If well 102 did not open to 180°, then port 104 could be less accessible.

In the example implementation of FIGS. 1-8, lid 10 includes an analogous arrangement between spout 300 and cap 200. That is, spout 300 includes a groove 302 formed in lever 318. Cap 200 includes a corresponding trough 224 configured for receiving groove 302 when spout 300 rotates from its closed position to its open position, as shown in FIG. 3. The arrangement of groove 302 and trough 224 permits spout 300 to rotate to a greater extent than what would otherwise be possible.

In the example implementation of FIGS. 1-8, body 100 includes a stop 112 in first well 102. Cap 200 includes a resilient pad 412 and a tab 212 adjacent pad 412. Tab 212 registers to stop 112 in first well 102 when cap 200 is in its closed position. A slot 226 formed around tab 212 on three sides allows tab 212 to flex slightly, pressing against pad 412 when cap 200 initially moves out of its closed position and tab 212 moves out of registration with stop 112. In the example implementation of FIGS. 1-8, stop 112 is a recess, but other known structures are conceivable.

In the example implementation of FIGS. 1-8, pad 412 is formed from a continuous material in common with port gasket 404 and other components of seal 400. Since tab 212 presses against pad 412 when cap 200 initially moves out of its closed position, tab 212 provides a restraining force, keeping pad 412 in position. If pad 412 is attached to port gasket 404, such as by a continuous material in common, then tab 212 pressing against pad 412 may also provide a restraining force keeping port gasket 404 in place on cap 200.

In addition to the restraining structure described above, the example implementation of FIGS. 1-8 includes additional restraining structures. For example, seal 400 includes a well 402 corresponding to a post 204 of cap 200. Post 204 fits inside well 402, restraining port gasket 404 in alignment with port 104. Also, seal 400 includes pillars 410 extending outward from bridge 416. Cap 200 includes slots 210 complementary to pillars 410. Pillars 410 registering inside slots 210 provides a restraining structure keeping seal 400 in place. Further, cap 200 includes arms 222 restraining pillars 410 inside slots 210.

Cap 200 still further includes a seat 218 complementary to spout gasket 406 for receiving and restraining spout gasket 406 in position. Cap 200 even further includes a seat 228 complementary to body gasket 408 for receiving body gasket 408. The combination of tube 414 of seal 400 inside passage 220 of cap 200 and sized in complementary fashion provides additional restraining structure, keeping related components of seal 400 in place.

The underside of body 100 shown in FIG. 5 includes a socket 126 configured for receiving a straw (not shown). With a straw installed, spout 300 in its open position, and cap 200 in its closed position, a user may sip liquid through spout 300 as an extension of a straw inserted into socket 126.

Figure 9:
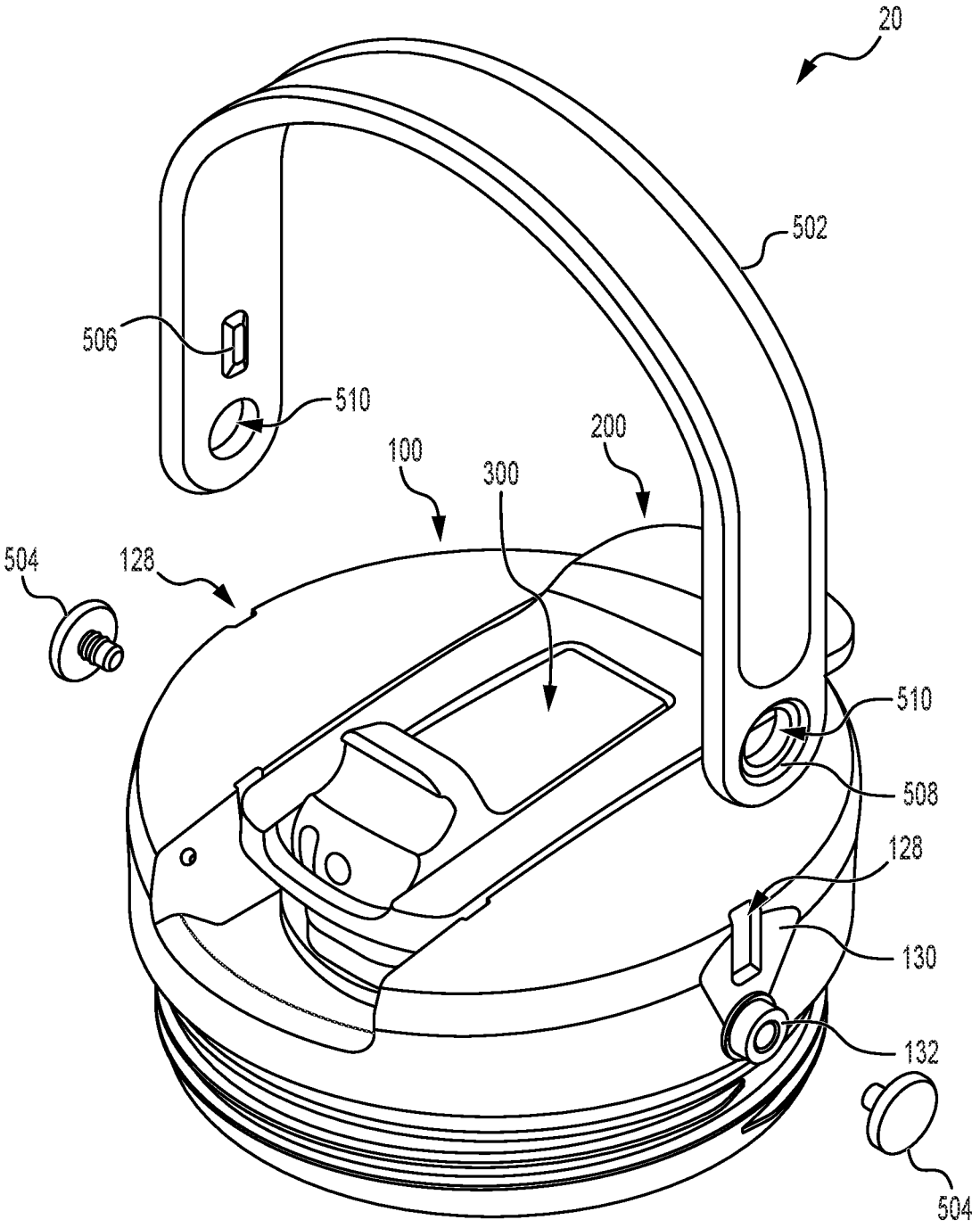
FIG. 9 is an isometric view of another example of the dispensing lid in FIG. 1 with a handle added.

FIG. 9 shows another example implementation in which a handle 502 is incorporated into the example implementation of FIGS. 1-8, providing a dispensing lid 20. Incorporation of handle 502 is accomplished by adding mount 132 to body 100 over which apertures 510 of handle 502 may be fitted. Pins 504 inserted through apertures 510 and into mounts 132 retain handle 502 in rotatable engagement with body 100. Additionally, recesses 508 formed around apertures 510 receive pins 504 so they are flush or substantially flush with the elevational level of handle 502.

In the example implementation of FIG. 9, dispensing lid 20 includes channels 128 formed in body 100 with bevels 130 adjacent channels 128. Bosses 506 formed on handle 502 facing body 100 are complementary to channels 128. Accordingly, during rotational movement about mounts 132, handle 502 may be releasably restrained in an upright position as bosses 506 slip over bevels 130 into channels 128. In this manner, handle 502 may be moved down on either side of lid 20 when desired, such as for dispensing from spout 300 or from port 104. Additionally, handle 502 may be retained in the upright position when desired, ready for easily grasping handle 502 of lid 20 and carrying the associated container (not shown).

Devices and Methods

The discoveries described herein identify a number of solutions that may be implemented in devices and methods also described herein. Multiple solutions may be combined for implementation, enabling still further devices and methods. The inventor expressly contemplates that the various options described herein for individual devices and methods are not intended to be so limited except where incompatible with other devices and methods. The features and benefits of individual devices herein may also be used in combination with methods and other devices described herein even though not specifically indicated elsewhere. Similarly, the features and benefits of individual methods herein may also be used in combination with devices and other methods described herein even though not specifically indicated elsewhere.

Device A is a dispensing lid for use with a container. The dispensing lid includes a body with a first well formed therein and a port and a conduit in the first well and extending through the body. The dispensing lid includes a cap in rotatable engagement with the body and having a second well formed therein. The cap is rotatable about a first axis of rotation from a closed position of the cap, in which the cap nests in the first well and engages with and closes the port, to an open position of the cap, in which the cap disengages from and opens the port, allowing dispensing through the lid via the port. The dispensing lid includes a spout in rotatable engagement with the cap and having a conduit extending therethrough. The spout is rotatable about a second axis of rotation from a closed position of the spout, in which the spout nests in the cap, to an open position of the spout, in which the conduit of the spout aligns with the conduit of the body when the cap is in its closed position, allowing dispensing through the lid via the spout.

Additional features may be implemented in Device A. By way of example, the cap may further include a passage in the second well, extending through the cap, and aligning with the conduit of the body when the cap is in its closed position. The conduit of the spout may align with the passage of the cap in the open position of the spout.

The first axis of rotation may be parallel to, and not coincident with, the second axis of rotation.

The rotatable engagement of the of the cap with the body may include a pair of pegs on opposing sides of the cap engaged inside a pair of sockets on opposing sides of the first well in the body.

The rotatable engagement of the of the spout with the cap may include a pair of pegs on opposing sides of the spout engaged inside a pair of sockets on opposing sides of the second well in the cap.

The cap may further include a resilient seal attached thereto. The seal may include a port gasket, a spout gasket, and a body gasket. The port gasket may engage with and close the port in the closed position of the cap. The spout gasket may engage between and with both the spout and other parts of the cap while the spout rotates from its closed position to its open position. The body gasket may engage between and with both the body and other parts of the cap in the closed position of the cap. The port gasket, the spout gasket, and the body gasket may be formed from a continuous material in common.

The seal may further include a bridge of the continuous material in common extending between the port gasket and the body gasket and a tube of the continuous material in common extending between the body gasket and the spout gasket. A conduit through the tube may align with the conduit of the body and the conduit of the spout when the spout is in its open position and the cap is in its closed position, allowing dispensing through the lid via the spout.

The body may further include a duct in the first well and extending through the body. The spout may further include a duct formed therein. A duct through the tube may align with the duct of the body and the duct of the spout when the spout is in its open position and the cap is in its closed position, allowing venting through the lid via the spout during dispensing.

With or without the cap having the seal, the body may further include a duct in the first well and extending through the body. The spout may further include a duct formed therein. The duct of the spout may align with the duct of the body when the spout is in its open position and the cap is in its closed position, allowing venting through the lid via the spout during dispensing.

The body may further include a pair of bosses on opposing sides of the first well. The cap may further include a pair of stops on opposing sides of the cap, the pair of stops in the cap registering to the pair of bosses in the first well when the spout is in its closed position and the cap is in an open, retained position. The spout may further include a lever extending outward from the spout when the spout is in its closed position. The first well may further include a hollow shaped to receive the lever when the cap is in its open, retained position.

The body may further include a stop in the first well. The cap may further include a resilient pad and a tab adjacent the pad. The tab may register to the stop in the first well when the cap is in its closed position. The tab may flex and press against the pad when the cap initially moves out of its closed position and the tab moves out of registration with the stop.

The described additional features of Device A may also be implemented in other devices and methods herein.

Device B is a dispensing lid for use with a container. The dispensing lid includes a body with a first well formed therein and a port and a conduit in the first well and extending through the body. The dispensing lid includes a cap in rotatable engagement with the body and having a second well formed therein. The cap is rotatable about a first axis of rotation from a closed position of the cap, in which the cap nests in the first well and engages with and closes the port, to an open position of the cap, in which the cap disengages from and opens the port, allowing dispensing through the lid via the port. The dispensing lid includes a spout in rotatable engagement with the cap and having a conduit extending therethrough. The spout is rotatable about a second axis of rotation from a closed position of the spout, in which the spout nests in the cap, to an open position of the spout, in which the conduit of the spout aligns with the conduit of the body when the cap is in its closed position, allowing dispensing through the lid via the spout. A passage in the second well extends through the cap and aligns with the conduit of the body when the cap is in its closed position, the conduit of the spout aligning with the passage of the cap in the open position of the spout. The dispensing lid includes a duct in the first well and extending through the body and a duct formed in the spout. The duct of the spout aligns with the duct of the body when the spout is in its open position and the cap is in its closed position, allowing venting through the lid via the spout during dispensing.

Additional features may be implemented in Device B. By way of example, the first axis of rotation may be parallel to, and not coincident with, the second axis of rotation.

The rotatable engagement of the of the cap with the body may include a pair of pegs on opposing sides of the cap engaged inside a pair of sockets on opposing sides of the first well in the body.

The rotatable engagement of the of the spout with the cap may include a pair of pegs on opposing sides of the spout engaged inside a pair of sockets on opposing sides of the second well in the cap.

The cap may further include a resilient seal attached thereto. The seal may include a port gasket, a spout gasket, and a body gasket. The port gasket may engage with and close the port in the closed position of the cap. The spout gasket may engage between and with both the spout and other parts of the cap while the spout rotates from its closed position to its open position. The body gasket may engage between and with both the body and other parts of the cap in the closed position of the cap. The port gasket, the spout gasket, and the body gasket may be formed from a continuous material in common.

The described additional features of Device B may also be implemented in other devices and methods herein.

Device C is a dispensing lid for use with a container. The dispensing lid includes a body with a first well formed therein and a port and a conduit in the first well and extending through the body. The dispensing lid includes a cap in rotatable engagement with the body and having a second well formed therein and having a resilient seal attached thereto. The cap is rotatable about a first axis of rotation from a closed position of the cap, in which the cap nests in the first well and engages with and closes the port, to an open position of the cap, in which the cap disengages from and opens the port, allowing dispensing through the lid via the port. The dispensing lid includes a spout in rotatable engagement with the cap and having a conduit extending therethrough. The spout is rotatable about a second axis of rotation from a closed position of the spout, in which the spout nests in the cap, to an open position of the spout, in which the conduit of the spout aligns with the conduit of the body when the cap is in its closed position, allowing dispensing through the lid via the spout. A passage in the second well extends through the cap and aligns with the conduit of the body when the cap is in its closed position, the conduit of the spout aligning with the passage of the cap in the open position of the spout. The seal includes a port gasket, a spout gasket, and a body gasket. The port gasket engages with and closes the port in the closed position of the cap. The spout gasket engages between and with both the spout and other parts of the cap while the spout rotates from its closed position to its open position. The body gasket engages between and with both the body and other parts of the cap in the closed position of the cap. The port gasket, the spout gasket, and the body gasket are formed from a continuous material in common.

Additional features may be implemented in Device C. By way of example, the seal may further include a bridge of the continuous material in common extending between the port gasket and the body gasket and a tube of the continuous material in common extending between the body gasket and the spout gasket. A conduit through the tube may align with the conduit of the body and the conduit of the spout when the spout is in its open position and the cap is in its closed position, allowing dispensing through the lid via the spout.

The body may further include a duct in the first well and extending through the body. The spout may further include a duct formed therein. A duct through the tube may align with the duct of the body and the duct of the spout when the spout is in its open position and the cap is in its closed position, allowing venting through the lid via the spout during dispensing.

The described additional features of Device C may also be implemented in other devices and methods herein.

Although minima and maxima are listed for the above described ranges and other ranges designated herein, it should be understood that more narrow included ranges may also be desirable and may be distinguishable from prior art. Also, operational principles discussed herein may provide an additional basis for the lesser included ranges.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGURES

| | |
|---|---|
| 10 | lid |
| 20 | lid |
| 100 | body |
| 102 | first well |
| 104 | port |
| 106 | boss |
| 108 | side wall |
| 110 | thread |
| 112 | stop |
| 114 | socket |
| 116 | recess |
| 118 | hollow |
| 120 | conduit |
| 122 | duct |
| 124 | trough |
| 126 | socket |
| 128 | channel |
| 130 | bevel |
| 132 | mount |
| 200 | cap |
| 202 | second well |
| 204 | post |
| 206 | stop |
| 208 | ledge |
| 210 | slot |
| 212 | tab |
| 214 | peg |
| 216 | sockets |
| 218 | seat |
| 220 | passage |
| 222 | arm |
| 224 | trough |
| 226 | slot |
| 228 | seat |
| 230 | bevel |
| 300 | spout |
| 302 | groove |
| 316 | peg |
| 318 | lever |
| 320 | conduit |
| 322 | duct |
| 330 | bevel |
| 400 | seal |
| 402 | well |
| 404 | port gasket |
| 406 | spout gasket |
| 408 | body gasket |
| 410 | pillar |
| 412 | pad |
| 414 | tube |
| 416 | bridge |
| 420 | conduit |
| 422 | duct |
| 502 | handle |
| 504 | pin |
| 506 | boss |
| 508 | recess |
| 510 | aperture |

What is claimed is:

1. A dispensing lid for use with a container, the dispensing lid comprising:

a body including a first well formed therein and a port and a conduit in the first well and extending through the body;

a cap in rotatable engagement with the body and including a second well formed therein, the cap being rotatable about a first axis of rotation from a closed position of the cap, in which the cap nests in the first well and engages with and closes the port, to an open position of the cap, in which the cap disengages from and opens the port, allowing dispensing through the lid via the port;

a spout in rotatable engagement with the cap and including a conduit extending therethrough, the spout being rotatable about a second axis of rotation from a closed position of the spout, in which the spout nests in the cap, to an open position of the spout, in which the conduit of the spout aligns with the conduit of the body when the cap is in its closed position, allowing dispensing through the lid via the spout; and the first axis of rotation being parallel to, and not coincident with, the second axis of rotation.

2. A dispensing lid for use with a container, the dispensing lid comprising:

a body including a first well formed therein and a port and a conduit in the first well and extending through the body;

a cap in rotatable engagement with the body and including a second well formed therein, the cap being rotatable about a first axis of rotation from a closed position of the cap, in which the cap nests in the first well and engages with and closes the port, to an open position of the cap, in which the cap disengages from and opens the port, allowing dispensing through the lid via the port;

a spout in rotatable engagement with the cap and including a conduit extending therethrough, the spout being rotatable about a second axis of rotation from a closed position of the spout, in which the spout nests in the cap, to an open position of the spout, in which the conduit of the spout aligns with the conduit of the body when the cap is in its closed position, allowing dispensing through the lid via the spout;

a passage in the second well circumscribed by and extending through the cap and aligning with the conduit of the body when the cap is in its closed position; and the conduit of the spout aligning with the passage of the cap in the open position of the spout.

3. The dispensing lid of claim 2, wherein the cap further comprises a resilient seal attached thereto, the seal including:

a port gasket that engages with and closes the port in the closed position of the cap;

a spout gasket that engages between and with both the spout and other parts of the cap while the spout rotates from its closed position to its open position;

a body gasket that engages between and with both the body and other parts of the cap in the closed position of the cap; and the port gasket, the spout gasket, and the body gasket being formed from a continuous material in common.

4. The dispensing lid of claim 1, wherein the rotatable engagement of the of the cap with the body comprises a pair of pegs on opposing sides of the cap engaged inside a pair of sockets on opposing sides of the first well in the body.

5. The dispensing lid of claim 1, wherein the rotatable engagement of the of the spout with the cap comprises a pair of pegs on opposing sides of the spout engaged inside a pair of sockets on opposing sides of the second well in the cap.

6. The dispensing lid of claim 1, wherein the cap further comprises a resilient seal attached thereto, the seal including:

a port gasket that engages with and closes the port in the closed position of the cap;

a spout gasket that engages between and with both the spout and other parts of the cap while the spout rotates from its closed position to its open position;

a body gasket that engages between and with both the body and other parts of the cap in the closed position of the cap; and the port gasket, the spout gasket, and the body gasket being formed from a continuous material in common.

7. The dispensing lid of claim 6, wherein the seal further comprises:

a bridge of the continuous material in common extending between the port gasket and the body gasket;

a tube of the continuous material in common extending between the body gasket and the spout gasket; and a conduit through the tube that aligns with the conduit of the body and the conduit of the spout when the spout is in its open position and the cap is in its closed position, allowing dispensing through the lid via the spout.

8. The dispensing lid of claim 7, wherein:

the body further comprises a duct in the first well and extending through the body;

the spout further comprises a duct formed therein; and a duct through the tube aligns with the duct of the body and the duct of the spout when the spout is in its open position and the cap is in its closed position, allowing venting through the lid via the spout during dispensing.

9. The dispensing lid of claim 1, wherein:

the body further comprises a duct in the first well, separate from the conduit of the body, and extending through the body;

the spout further comprises a duct formed therein and separate from the conduit of the spout; and the duct of the spout aligns with the duct of the body when the spout is in its open position and the cap is in its closed position, allowing venting through the lid via the spout during dispensing.

10. The dispensing lid of claim 1, wherein:

the body further comprises a pair of bosses on opposing sides of the first well;

the cap further comprises a pair of stops on opposing sides of the cap, the pair of stops in the cap registering to the pair of bosses in the first well when the spout is in its closed position and the cap is in an open, retained position;

the spout further comprises a lever extending outward from the spout when the spout is in its closed position; and the first well further comprises a hollow shaped to receive the lever when the cap is in its open, retained position.

11. The dispensing lid of claim 1, wherein:

the body further comprises a stop in the first well;

the cap further comprises a resilient pad and a tab adjacent the pad, the tab registering to the stop in the first well when the cap is in its closed position and the tab flexing and pressing against the pad when the cap initially moves out of its closed position and the tab moves out of registration with the stop.

12. A dispensing lid for use with a container, the dispensing lid comprising:

a body including a first well formed therein and a port and a conduit in the first well and extending through the body;

a cap in rotatable engagement with the body and including a second well formed therein, the cap being rotatable about a first axis of rotation from a closed position of the cap, in which the cap nests in the first well and engages with and closes the port, to an open position of the cap, in which the cap disengages from and opens the port, allowing dispensing through the lid via the port;

a spout in rotatable engagement with the cap and including a conduit extending therethrough, the spout being rotatable about a second axis of rotation from a closed position of the spout, in which the spout nests in the cap, to an open position of the spout, in which the conduit of the spout aligns with the conduit of the body when the cap is in its closed position, allowing dispensing through the lid via the spout;

a passage in the second well circumscribed by and extending through the cap and aligning with the conduit of the body when the cap is in its closed position, the conduit of the spout aligning with the passage of the cap in the open position of the spout; and a duct in the first well, separate from the conduit of the body, and extending through the body; and a duct formed in the spout and separate from the conduit of the spout the duct of the spout aligning with the duct of the body when the spout is in its open position and the cap is in its closed position, allowing venting through the lid via the spout during dispensing.

13. The dispensing lid of claim 12, wherein the first axis of rotation is parallel to, and not coincident with, the second axis of rotation.

14. The dispensing lid of claim 12, wherein the rotatable engagement of the of the cap with the body comprises a pair of pegs on opposing sides of the cap engaged inside a pair of sockets on opposing sides of the first well in the body.

15. The dispensing lid of claim 12, wherein the rotatable engagement of the of the spout with the cap comprises a pair of pegs on opposing sides of the spout engaged inside a pair of sockets on opposing sides of the second well in the cap.

16. The dispensing lid of claim 12, wherein the cap further comprises a resilient seal attached thereto, the seal including:

a port gasket that engages with and closes the port in the closed position of the cap;

a spout gasket that engages between and with both the spout and other parts of the cap while the spout rotates from its closed position to its open position;

a body gasket that engages between and with both the body and other parts of the cap in the closed position of the cap; and the port gasket, the spout gasket, and the body gasket being formed from a continuous material in common.

17. A dispensing lid for use with a container, the dispensing lid comprising:

a body including a first well formed therein and a port and a conduit in the first well and extending through the body;

a cap in rotatable engagement with the body and including a second well formed therein and including a resilient seal attached thereto, the cap being rotatable about a first axis of rotation from a closed position of the cap, in which the cap nests in the first well and engages with and closes the port, to an open position of the cap, in which the cap disengages from and opens the port, allowing dispensing through the lid via the port;

a spout in rotatable engagement with the cap and including a conduit extending therethrough, the spout being rotatable about a second axis of rotation from a closed position of the spout, in which the spout nests in the cap, to an open position of the spout, in which the conduit of the spout aligns with the conduit of the body when the cap is in its closed position, allowing dispensing through the lid via the spout;

a passage in the second well extending through the cap and aligning with the conduit of the body when the cap is in its closed position, the conduit of the spout aligning with the passage of the cap in the open position of the spout; and the seal including:

a port gasket that engages with and closes the port in the closed position of the cap;

a spout gasket that engages between and with both the spout and other parts of the cap while the spout rotates from its closed position to its open position;

a body gasket that engages between and with both the body and other parts of the cap in the closed position of the cap; and the port gasket, the spout gasket, and the body gasket being formed from a continuous material in common.

18. The dispensing lid of claim 17, wherein the seal further comprises:

a bridge of the continuous material in common extending between the port gasket and the body gasket;

a tube of the continuous material in common extending between the body gasket and the spout gasket through the passage of the cap; and a conduit through the tube that aligns with the conduit of the body and the conduit of the spout when the spout is in its open position and the cap is in its closed position, allowing dispensing through the lid via the spout.

19. The dispensing lid of claim 18, wherein:

the body further comprises a duct in the first well, separate from the conduit of the body, and extending through the body;

the spout further comprises a duct formed therein and separate from the conduit of the spout; and a duct through the tube aligns with the duct of the body and the duct of the spout when the spout is in its open position and the cap is in its closed position, allowing venting through the lid via the spout during dispensing.

20. The dispensing lid of claim 17, wherein:

the body further comprises a duct in the first well, separate from the conduit of the body, and extending through the body;

the spout further comprises a duct formed therein and separate from the conduit of the spout; and the duct of the spout aligns with the duct of the body when the spout is in its open position and the cap is in its closed position, allowing venting through the lid via the spout during dispensing.

* * * * *